US008307622B2

(12) United States Patent
Beckmann et al.

(10) Patent No.: US 8,307,622 B2
(45) Date of Patent: Nov. 13, 2012

(54) TWO-FOR-ONE TWISTING OR CABLING SPINDLE

(75) Inventors: Markus Beckmann, Krefeld (DE); Georg Heinen, Krefeld (DE); Wolfgang Leupers, Mönchengladbach (DE); Gerd Pöhlmann, Krefeld (DE); Jürgen Schnitzler, Viersen (DE); Dieter Strahlen, Dormagen (DE); Georg Tetzlaff, Aachen (DE)

(73) Assignee: Oerlikon Textile GmbH & Co. KG., Remscheid (DE)

( * ) Notice: Subject to any disclaimer, the term of this patent is extended or adjusted under 35 U.S.C. 154(b) by 0 days.

(21) Appl. No.: 13/078,465

(22) Filed: Apr. 1, 2011

(65) Prior Publication Data

US 2011/0239617 A1 Oct. 6, 2011

(30) Foreign Application Priority Data

Apr. 3, 2010 (DE) ..... 10 2010 013 795

(51) Int. Cl.
*D01H 7/86* (2006.01)

(52) U.S. Cl. ..... 57/58.83

(58) Field of Classification Search ..... 57/58.49–58.86
See application file for complete search history.

(56) References Cited

U.S. PATENT DOCUMENTS

| | | | | |
|---|---|---|---|---|
| 3,623,312 | A | 11/1971 | Gutbrod | |
| 3,855,773 | A * | 12/1974 | Davis | 57/58.83 |
| 4,334,404 | A | 6/1982 | Franzen | |
| 4,642,980 | A | 2/1987 | Fukunaga et al. | |
| 5,361,571 | A * | 11/1994 | Joyce | 57/58.76 |
| 5,979,154 | A * | 11/1999 | Dur | 57/58.83 |
| 2003/0110753 | A1 * | 6/2003 | Galan Pujol | 57/58.49 |
| 2010/0018178 | A1 | 1/2010 | Fink et al. | |

FOREIGN PATENT DOCUMENTS

| | | | |
|---|---|---|---|
| DE | 1813801 | | 12/1968 |
| DE | 2931391 | C2 | 2/1981 |
| DE | 3347318 | A1 | 12/1983 |
| DE | 4404555 | C1 | 6/1995 |
| DE | 102006029055 | A1 | 12/2007 |

* cited by examiner

*Primary Examiner* — Shaun R Hurley
(74) *Attorney, Agent, or Firm* — K&L Gates LLP

(57) ABSTRACT

A two-for-one twisting or cabling spindle apparatus (1) with a supply bobbin (4) mounted on a pot base (2) of a stationary protective pot (3) and a spindle (6) arranged below the protective pot (3) to guide a yarn (5) to be processed during a twisting or cabling process. The spindle (6) is rotatably mounted by a lower bearing device (7) in a bearing housing (9) fixed on a spindle rail (8) and an upper bearing device (11) mounted to the stationary protective pot (3). The largest diameter (d) of the rotatably mounted spindle (6) is at least 10% less than the diameter (D) of a touching line (23) of the pot base (2) of the stationary protective pot (3) with the yarn (5).

12 Claims, 5 Drawing Sheets

TWO-FOR-ONE TWISTING OR CABLING SPINDLE

CROSS-REFERENCE TO RELATED APPLICATIONS

This application claims the benefit of German patent application DE 10 2010 013 795.2, filed Apr. 3, 2010, herein incorporated by reference.

BACKGROUND OF THE INVENTION

The invention relates to a two-for-one twisting or cabling spindle apparatus.

Modern two-for-one twisting or cabling spindle apparatus generally have a stationary protective pot to receive a supply bobbin, a hollow bobbin axle to guide a yarn through the twisting spindle apparatus and a rotatably mounted, driveable spindle arranged below the supply bobbin. In other words, in two-for-one twisting or cabling spindle apparatus of this type, the yarn is drawn off upwardly from a stationary supply bobbin, inserted into the upper end of the hollow bobbin axle and deflected downwardly in the process. Within the bobbin axle, the yarn is guided via a yarn brake and then leaves the region of the bobbin axle via a radial opening, which is arranged in a component of the rotatably mounted, driveable spindle. After leaving the radial opening, the yarn is temporarily stored on a storage disc of the spindle before it is guided to a stationary balloon yarn guide arranged above the protective pot. In the process, the yarn forms a yarn balloon rotating about the protective pot because of the rotation of the spindle between a so-called discharge plate arranged in the region of the storage disc and a balloon yarn guide arranged above the protective pot. After passing the balloon yarn guide, the twisted yarn is wound by a winding mechanism to form a take-up bobbin.

In two-for-one twisting or cabling spindle apparatus of this type, the shape and size of the yarn balloon being formed during the twisting process depend inter alfa on the diameter of the yarn discharge element of the spindle. In other words, the two-for-one twisting or cabling spindle apparatus often have, as described, for example in German Patent Publication DE 10 2006 029 055 A1, a spindle driven by means of a tangential belt, which in turn has a revolving storage disc and a yarn discharge plate fixed to the storage disc and arranged above the storage disc.

In order to prevent the yarn balloon coming into contact with the stationary protective pot during the twisting process in the case of friction-sensitive yarn materials, such as, for example, polypropylene, polyester or polyacrylics, which risks a yarn break, the diameter of this known yarn discharge plate is dimensioned such that it is above the diameter of the stationary protective pot. This means that the yarn balloon circulating between the yarn discharge plate and the balloon yarn guide arranged above the protective pot generally has a relatively large diameter.

However, as it is known that large yarn balloons lead to relatively large ventilation losses and therefore to an increased energy requirement of the two-for-one twisting spindle, various tests have already been carried out in the past, in particular in connection with less friction-sensitive yarn materials, such as, for example, cotton, to reduce or limit the diameter of the yarn balloons.

Two-for-one twisting spindle apparatus are described, for example, in German Patent Publication DE 44 04 555 C1 which, in addition to a stationary protective pot receiving the supply bobbin have a cylinder-like balloon limiter comprising the protective pot.

In two-for-one twisting spindle apparatus of this type, the production of a yarn balloon which is relatively large in diameter is effectively prevented in that the yarn immediately runs onto the inside of the balloon limiter after leaving the yarn discharge plate, which is relatively large in diameter, of the spindle.

The drawback in these known two-for-one twisting spindle apparatus is, however, the relatively long physical contact of the revolving yarn balloon with the stationary balloon limiter. As the stresses acting on the yarn owing to such stationary balloon limiters are relatively high, two-for-one twisting spindle apparatus of this type can only be used for relatively insensitive yarns.

Comparable two-for-one twisting spindle apparatus with stationary balloon limiters are also known from German Patent Publications DE-OS 1 813 801 or DE 33 47 318 A1.

In the two-for-one twisting spindle apparatus according to German Patent Publication DE-OS 1 813 801, the supply bobbin is, however, not arranged for protection in a stationary protective pot, but stands open on a component of the two-for-one twisting spindle apparatus configured as a bobbin carrier. In order to avoid contacts between the revolving yarn balloon supported outwardly on a cylindrical balloon limiter and the supply bobbin, a cylinder-like yarn guide arranged between the balloon limiter and the supply bobbin is also provided in these two-for-one twisting spindle apparatus and surrounds the supply bobbin at the level of the balloon limiter upper edge.

The two-for-one twisting spindle apparatus according to German Patent Publication DE 33 47 318 A1 has a bulky cylindrical balloon limiter, in which a stationary protective pot, which has conical end regions, is mounted.

Thus, also in the two-for-one twisting spindle apparatus known from German Patent Publication DE-OS 1 813 801 or DE 33 47 318 A1, the maximum diameter of the developing yarn balloon is predetermined by the internal diameter of a stationary, outer balloon limiter, so the yarns to be processed are not insignificantly loaded during the twisting process.

Furthermore, a two-for-one twisting spindle apparatus is described in German Patent Publication DE 19 31 291 C2, in which the stationary protective pot, which has a supply container for a lubricant in the base region, is slightly convexly rounded. The protective pot is also equipped, in the region of the supply container, with an annular disc, which consists of an absorbent material. In this known two-for-one twisting spindle apparatus, the yarn, after leaving the yarn discharge plate, which is relatively large in diameter, of the spindle, slides over the annular disc on the protective pot and in the process is wetted with a lubrication or a lubricating means.

SUMMARY OF THE INVENTION

Proceeding from the prior art described above, the invention is based on the object of modifying a two-for-one twisting or cabling spindle apparatus in such a way that the yarn balloons being produced during the twisting or cabling process are as slim as possible, wherein the above described drawbacks, in particular the yarn sliding along an outer, stationary balloon limiter, are to be avoided.

This object is achieved according to the invention by a two-for-one twisting or cabling spindle apparatus having a supply bobbin mounted on a pot base of a stationary protective pot and a spindle arranged below the protective pot to guide a yarn to be processed during the twisting or cabling process. The spindle is rotatably mounted by means of a lower bearing device in a bearing housing fixed on a spindle rail and an upper bearing device mounted to the stationary protective pot. According to the invention, the largest diameter of the rotatably mounted spindle is at least 10% less than the diameter of a touching line of the pot base of the stationary protective pot with the yarn.

Advantageous further configurations, features and advantages of the invention are described more fully hereinafter.

Relatively slim yarn balloons can be realised with a two-for-one twisting or cabling spindle apparatus, wherein the largest diameter of the rotatably mounted hollow spindle is at least 10% less than the diameter of a touching line of the pot base of the stationary protective pot with the yarn. These slim yarn balloons have the advantage that the ventilation losses occurring during operation at the two-for-one twisting or cabling spindle apparatus are clearly reduced, which leads to a noticeable reduction in the drive energy required during the operation of such two-for-one twisting or cabling spindle apparatus.

According to one advantageous embodiment, the rotatably mounted spindle, which guides the yarn during the twisting or cabling process, has a storage disc, on the lateral surface of which the yarn slides. As a storage disc of this type is necessary in any case to compensate the yarn tension fluctuations occurring during the twisting or cabling process by a temporary storage of the yarn, the use of the storage disc as a yarn discharge element represents an economical embodiment. In other words, the use of a yarn discharge plate is dispensed with in such an embodiment.

However, it may also be provided in an alternative embodiment that the spindle, apart from the storage disc, also has a yarn discharge plate fixed to the storage disc. A yarn discharge plate is generally fixed to the top of the storage disc and is an advantageous yarn guide means. In other words, a yarn discharge plate of this type ensures that the yarn is guided gently upward after leaving the storage disc and in the process forms a slim yarn balloon.

According to another advantageous embodiment, the yarn discharge plate has a curve-like edge region, which revolves with play during the twisting or cabling process in an annular recess, which is open at the bottom, of the pot base of the protective pot. The air swirls generally occurring in the edge region of a rotating yarn discharge plate can be minimised by a configuration of this type.

Another advantageous embodiment provides that the pot base of the stationary protective pot has, on its outside, along which the yarn slides during the twisting or cabling process, a yarn-friendly deflection radius. Owing to a yarn-friendly deflection radius of this type, the measurement of which is between 8 mm and 20 mm, it is ensured that the yarn sliding along the pot base during the twisting or cabling process is not too strongly loaded or even damaged.

In an alternative embodiment, it is provided that an adapter, which is non-rotatably connected to the pot base of the protective pot, is arranged below the stationary protective pot.

By switching on an adapter of this type, the touching face of the yarn on the pot base can be minimised and, at the same time, the yarn balloon being produced during the twisting process can be made slimmer.

To optimise the yarn guidance below the protective pot, it may also be provided that the adapter has a conical casing piece reaching to the discharge plate and arranged on the pot base engaging over it.

It is provided in a further alternative embodiment that the protective pot, below the touching line of the yarn with the protective pot, has a conical region. Optimal receiving of conical or biconical supply bobbins in the protective pot is made possible by a configuration of this type of the protective pot, in a simple manner. In other words, the protective pot can also always be maximally equipped during the processing of a supply bobbin configured in this manner.

In order to reliably ensure that the yarn is gently guided during the twisting or cabling process in the region of its touching line, it is provided in an advantageous embodiment that the protective pot is equipped in this region with a guide ring or a guide bead. The guide ring or guide bead are, in this case, preferably manufactured from a hard and yarn-friendly material, for example of chrome-plated or polished steel and ensure that the yarn cannot be damaged during the twisting or cabling process by the stationary protective pot.

The guide ring or the guide bead is either fastened to the pot base of the protective pot or fixed in the lower part of the lateral pot surface of the protective pot. Both sites have proven advantageous in practice.

In order to be able to realise a yarn balloon which is as slim as possible during the twisting process, it is provided that a spacing a, which may be between 1 and 120 mm, is provided between the peripheral line of the protective pot touched by the yarn during the twisting process and the lower edge of the storage disc. A relatively large spacing of this type may be easily achieved by the use of an adapter, which is positioned below the protective pot. As already described, a relatively large spacing a leads to the fact that the yarn balloon produced during the twisting process is stretched and therefore kept slim.

BRIEF DESCRIPTION OF THE DRAWINGS

Further details of the invention can be inferred from the embodiments described below with the aid of the figures, in which.

DETAILED DESCRIPTION OF THE PREFERRED EMBODIMENTS

Figure 1:
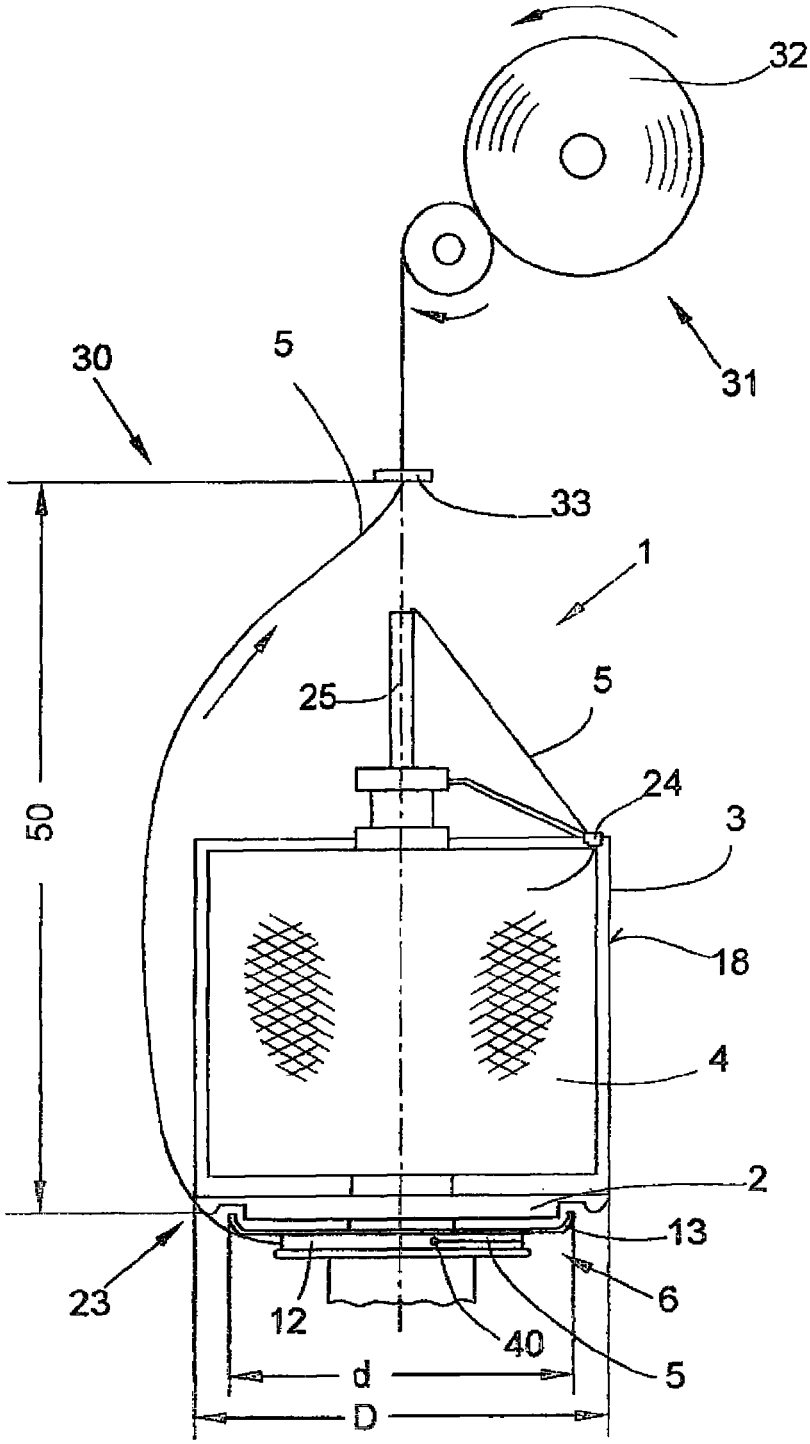
FIG. 1 schematically shows a workstation of a two-for-one twisting machine, the two-for-one twisting or cabling spindle apparatus having a stationary protective pot, in which a supply bobbin is arranged, and a rotatably mounted spindle is provided, the largest diameter of which is considerably less than the diameter of the protective pot, FIG. 2 sectionally shows a first embodiment of a two-for-one twisting or cabling spindle apparatus, the rotatably mounted spindle of the two-for-one twisting or cabling spindle apparatus being equipped with a storage disc and a discharge plate, FIG. 3 sectionally shows further embodiments of a two-for-one twisting or cabling spindle apparatus, the rotatably mounted spindle of which is in each case only equipped with one storage disc.

FIG. 1 schematically shows one representative workstation 30 of a multi-station two-for-one twisting or cabling machine (not shown in more detail). Workstations 30 of this type inter alia have a two-for-one twisting or cabling spindle apparatus 1, with a supply bobbin 4 mounted in a stationary protective pot 3 as well as a winding mechanism 31 for winding the twisted yarn 5 to form a take-up bobbin 32.

The stationary protective pot 3, which has a lateral pot surface 18 defining a relatively large diameter D, has a pot base 2. A rotatably mounted spindle 6 of the two-for-one twisting or cabling spindle apparatus 1 is arranged below the pot base 2.

In the embodiment shown in FIG. 1, the spindle 6, to rotate and guide the yarn 5 during the twisting or cabling process, is equipped with a storage disc 12 as well as with a yarn discharge plate 13, the diameter d of the yarn discharge plate 13, which in this case forms the largest diameter of the rotatably mounted spindle 6, as can be seen, being clearly below the diameter D of the stationary protective pot 3.

As also shown in FIG. 1, during the twisting or cabling operation, a yarn 5 guided by a rotatably mounted yarn guide 24 is drawn off from the supply bobbin 4 and yarned from above into the hollow bobbin axle 25 of the two-for-one twisting or cabling spindle apparatus 1. The yarn is then, as known and therefore not described in more detail, loaded within the bobbin axle 25 by a yarn brake (not shown) and guided outwardly over the rotatably driven spindle 6. In other words, the yarn 5 arrives via a radial opening 40 in the storage disc 12 of the rotating spindle onto the circular peripheral or lateral surface of the storage disc 12, where it is temporarily stored depending on the respectively present yarn tension. The yarn 5 leaves the rotating spindle 6 in the embodiment shown via the yarn discharge plate 13, the yarn 5 forming a relatively slim yarn balloon 50 during the twisting or cabling process between a touching line 23 in the region of the pot base 2 of the protective pot 3 and a stationary balloon yarn guide 33 arranged above the protective pot 3.

After running through the stationary balloon yarn guide 33, the twisted yarn 5 is wound by means of the winding mechanism 31 to form a take-up bobbin 32.

Figure 2:
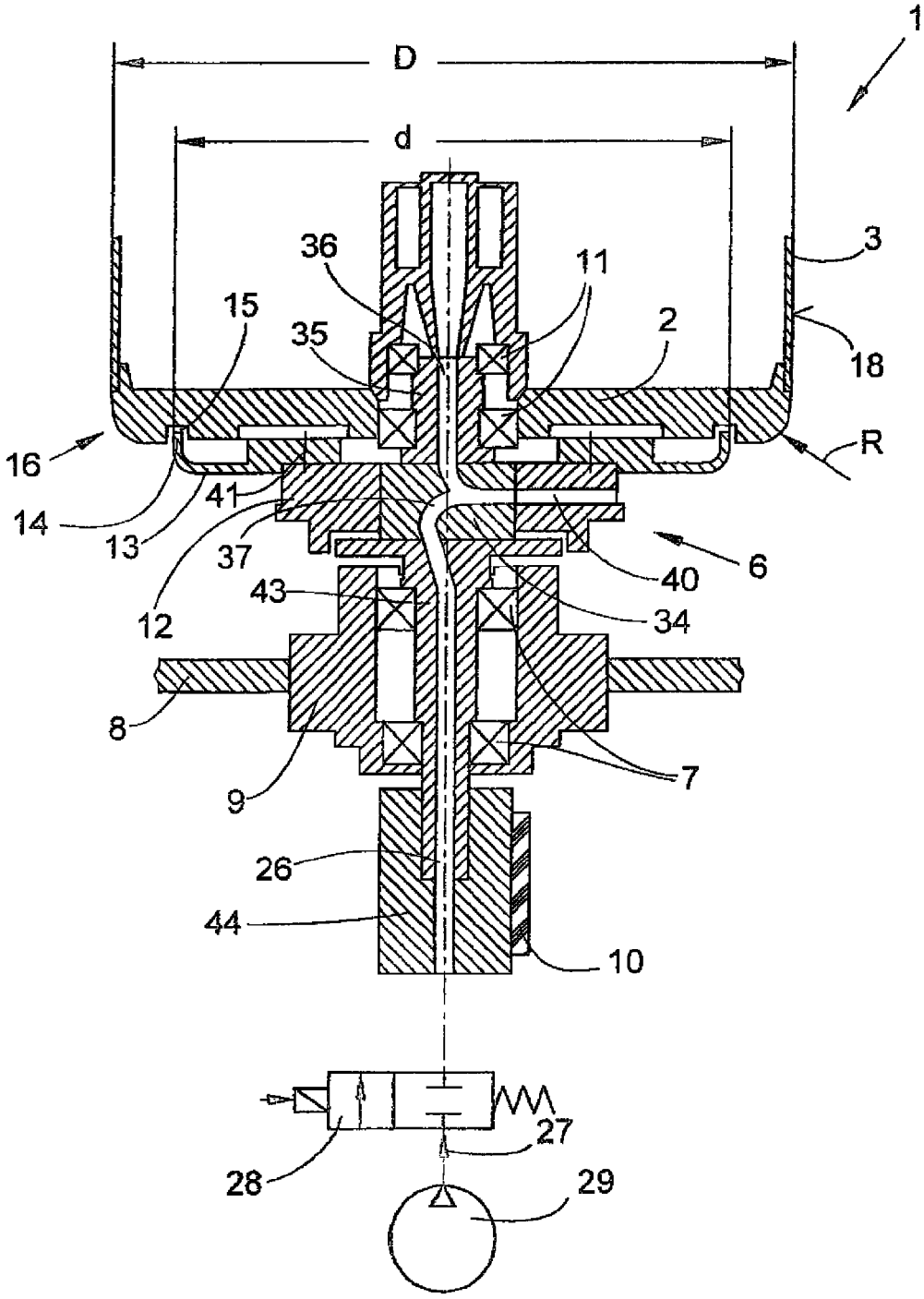

FIG. 2 in detail shows a first embodiment of the two-for-one twisting or cabling spindle apparatus 1 according to the invention, both the rotatably mounted spindle 6 and the upper bearing device 11 for the stationary protective pot 2 and the bearing device 7 arranged below the stationary protective pot 2 for the spindle 6 being shown in section. As indicated, the bearing devices 7 and 11 preferably in each case have two roller bearings arranged axially spaced apart from one another.

As can also be seen, arranged in a bearing housing 9, which is fixed in a spindle rail 8 of the two-for-one twisting or cabling machine, is the bearing device 7, in which the spindle 6 of the two-for-one twisting or cabling spindle apparatus 1 with its spindle shaft 43 is rotatably mounted. A wharve 44, which is loaded during the twisting process by a driveable tangential belt 10, is pressed onto the lower end of the spindle shaft 43. A bore 26, which is used to facilitate the yarning of the yarn 5 into the two-for-one twisting or cabling spindle apparatus 1 and which is connected by a pressure line 27 and a valve device 28, which can be activated in a defined manner, to a compressed air source 29, preferably runs within the spindle shaft 43 and the wharve 44. A storage disc 12 is non-rotatably connected to an intermediate part 34, which is preferably a component of the spindle shaft 43. A spindle starting part 35, also non-rotatably connected to the spindle shaft 43 forms the basis for the bearing device 11 of the stationary protective pot 3. The bearing device 11, for example, has two roller bearings arranged axially spaced apart with respect to one another. In other words, the roller bearings are fastened by their inner rings on the spindle starting part 35, while the pot base 2 of the protective pot 3 is mounted on the outer rings of these roller bearings. As can be seen, the intermediate part 34 and the spindle starting part 35 are also equipped with inner bores, the bore 36 of the spindle starting part 35 and the bore 37 of the intermediate part 34 passing into the radial opening 40 of the storage disc 12. According to the first embodiment shown in FIG. 2, fastened to the storage disc 12, for example by means of screw bolts 41, is a yarn discharge plate 13, the largest diameter d of which is clearly, in other words, at least 10%, below the diameter D of the stationary protective pot 3. The yarn discharge plate 13 engages here with play with its upwardly bent edge region 14 in a circular recess 15 which is open at the bottom and arranged on the lower side of the pot base 2.

As can also be seen from FIG. 2, the pot base 2, in the region of its outside 16, has a deflection radius R designed in a yarn-friendly manner. The size of this deflection radius may, for example, depending on the yarn count range to be processed by the two-for-one twisting or cabling spindle, be between 8 mm and 20 mm.

Figure 3:
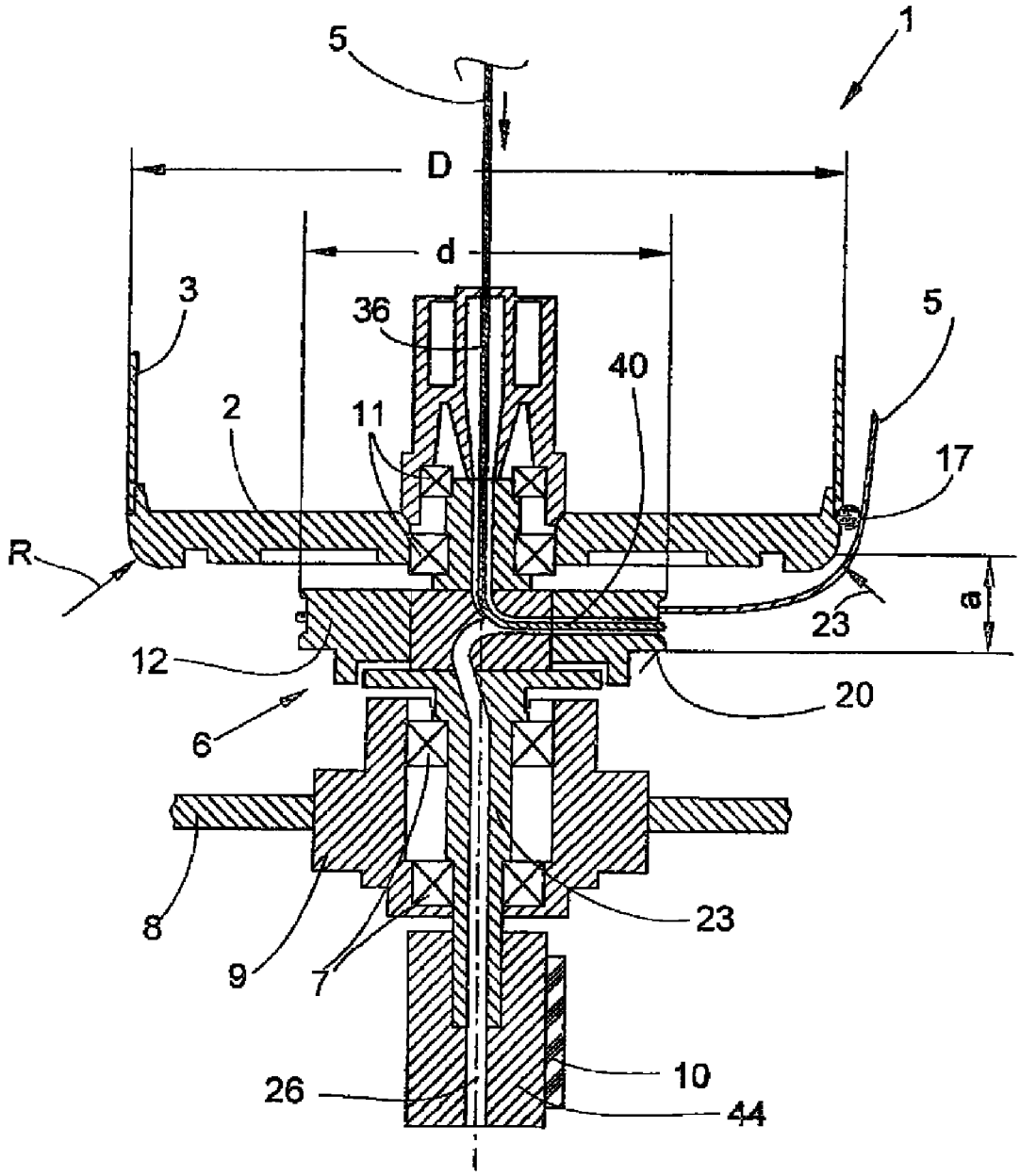

FIG. 3 shows further embodiments of a two-for-one twisting or cabling spindle apparatus 1 configured according to the invention. An important difference from the first embodiment of a two-for-one twisting or cabling spindle apparatus 1 shown in FIGS. 1 and 2 is that in the embodiment according to FIG. 3, the rotatably mounted spindle 6 has no yarn discharge plate.

As shown in FIG. 3, the yarn 5 arrives, during the twisting or cabling process, through the bobbin axle 25 or the bore 36 at the radial bore 40 of the spindle 6. The yarn 5 leaving the radial opening 40 is then temporarily stored on the circular peripheral or lateral surface of the storage disc 12, before it is deflected in the direction of the pot base 2 of the stationary protective pot 2. The yarn 5 is tangential to the pot base 2 here in the region of a touching line 23, the touching line 23 of the yarn 5, depending on the embodiment of the pot base 2 or the protective pot 3, being either in the region of a friction-friendly deflection radius (see left-hand image side of FIG. 3) or, as shown on the right-hand image side, in the region of a guide ring or a guide bead 17 fastened, for example, to the protective pot 3.

In these embodiments, the maximum diameter d of the spindle 6 is in each case produced from the diameter of the storage disc 12.

Figure 4:
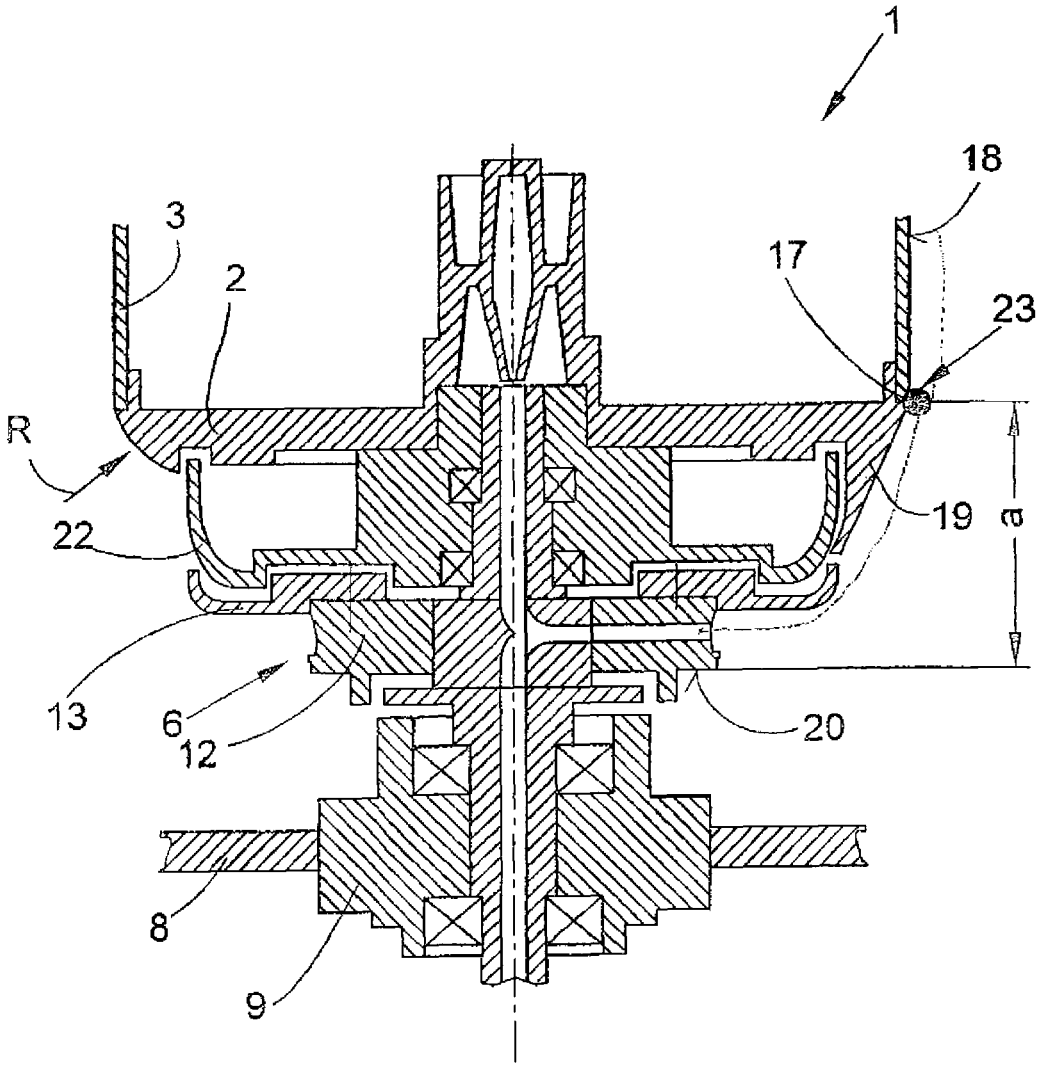
FIG. 4 shows further embodiments of a two-for-one twisting or cabling spindle apparatus, an adapter being connected, in each case, between the stationary protective pot and the discharge plate of the rotatably mounted spindle, also in section.

The embodiments of a two-for-one twisting or cabling spindle apparatus 1 shown in FIG. 4 differ, in particular, from the embodiment of a two-for-one twisting or cabling spindle apparatus 1 shown in FIGS. 1 and 2 by an additional adapter 22. This additional adapter 22 is arranged between the pot base 2 of the stationary protective pot 3 and the yarn discharge plate 13 of the spindle 6 and is preferably non-rotatably connected to the protective pot 2. By means of an adapter 22 of this type, the spacing designated at "a" in FIG. 4 between the lower edge 20 of the storage disc 12 and the touching line 23 to which the yarn 5 is tangential during the twisting or cabling process, can be increased to up to 120 mm.

In the embodiment of a two-for-one twisting or cabling spindle apparatus 1 with adapter 22, this region may either be open, as shown in the left-hand image half of FIG. 4, or, as shown in the right-hand image half of FIG. 4, may be bridged by a conical casing piece 19, which is, for example, part of the pot base 2. In other words, the pot base 2, in an embodiment of this type, on its lower side, has a conical extension pointing downward. The conical shoulder 19 in this case preferably begins just below the touching line 23 formed, for example, by a guide ring 17 and to which the yarn 5 is tangential during the twisting or cabling process and ends just above the yarn discharge plate 13 of the rotatably mounted spindle 6.

Obviously, it is also possible to increase the above-described spacing a between the lower edge 20 of the storage disc 12 and the touching line 23 to which the yarn 5 is tangential during the twisting or cabling process to up to 120 mm, without an additional adapter, which can be fixed to the protective pot, being used. In a case such as this, for example, the protective pot may simply be enlarged downwardly by the length of an adapter.

In the embodiments according to FIG. 4, various configurations are also possible in the region of the touching line 23 to which the yarn 5 is tangential during the twisting or cabling process. The region of the touching line 23 may, for example, either be made less sharp by a yarn-friendly deflection radius R, as shown on the left-hand image side of FIG. 4, or, as indicated on the right-hand image side of FIG. 4, a guide ring 17 or a guide bead is installed in the region of the touching line 23.

Figure 5:
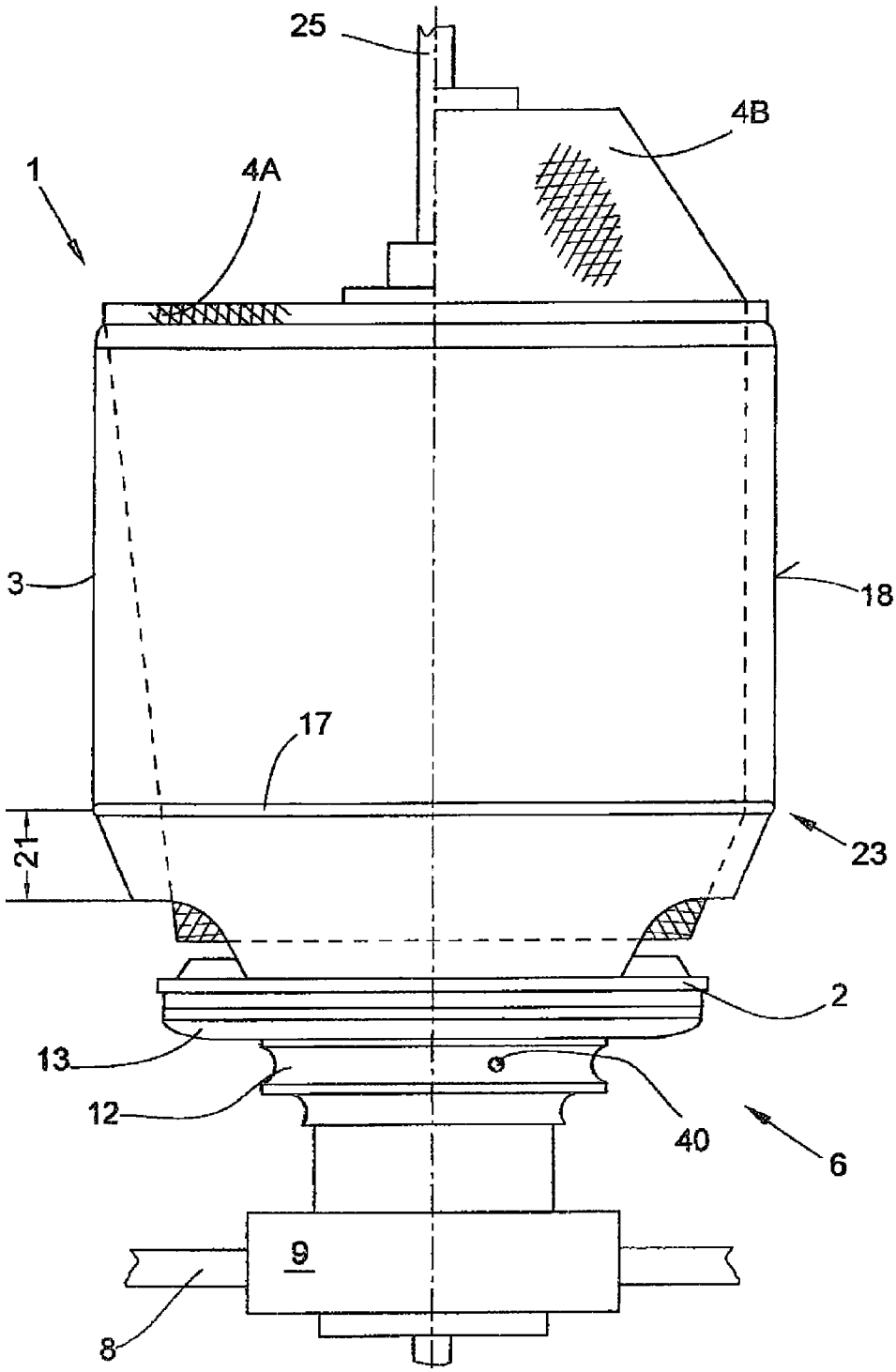
FIG. 5 shows further embodiments of a two-for-one twisting or cabling spindle apparatus, the protective pot being designed to receive a conical or biconical supply bobbin.

FIG. 5 shows a two-for-one twisting or cabling spindle apparatus 1, with a stationary protective pot 3, which has a conical region 21 below the touching line 23 to which the yarn 5 is tangential during the twisting or cabling process, a guide bead or a guide ring 17 preferably being arranged in the region of said touching line. Conical supply bobbins 4A, as shown in the left-hand image half of FIG. 5, and biconical supply bobbins 4B, as shown in the right-hand image half, can be advantageously mounted, in other words utilising the maximum receiving volume, in such a protective pot 3 designed in a partially conical manner.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Two-for-one twisting or cabling spindle apparatus (1) comprising a supply bobbin (4) mounted within a stationary protective pot (3) and a spindle (6) arranged below the protective pot (3) to guide a yarn (5) to be processed during a twisting or cabling process, the spindle (6) being rotatably mounted by means of a lower bearing device (7) in a bearing housing (9) fixed on a spindle rail (8) and an upper bearing device (11) mounted to the stationary protective pot (3), wherein the largest diameter (d) of the rotatably mounted spindle (6) is at least 10% less than the diameter (D) of a touching line (23) of the stationary protective pot (3) with the yarn (5), and the yarn (5), between touching line (23) and a stationary balloon yarn guide (33) disposed above the protective pot (3), forms a relatively narrow yarn balloon (50).

2. Two-for-one twisting or cabling spindle apparatus according to claim 1, characterised in that the spindle (6) has a storage disc (12), on the peripheral face of which the yarn (5) to be processed is temporarily guided during the twisting or cabling process.

3. Two-for-one twisting or cabling spindle apparatus according to claim 1, characterised in that the spindle (6) has a storage disc (12) as well as a yarn discharge plate (13) connected to the storage disc (12).

4. Two-for-one twisting or cabling spindle apparatus according to claim 3, characterised in that the yarn discharge plate (13) has a curved edge region (14), which revolves with play during the twisting or cabling operation in an annular recess (15), which is open at the bottom, of the protective pot (3).

5. Two-for-one twisting or cabling spindle apparatus according to claim 1, characterised in that the protective pot (3), on its outside (16), along which the yarn (5) slides during the twisting or cabling process, has a friction-friendly deflection radius (R), which is between 8 and 20 mm.

6. Two-for-one twisting or cabling spindle apparatus according to claim 1, characterised in that an adapter (22) is arranged below the protective pot (3).

7. Two-for-one twisting or cabling spindle apparatus according to claim 6, characterised in that the adapter (22) has a conical casing piece (19) reaching to the discharge plate (13) and arranged on the protective pot (3) engaging over it.

8. Two-for-one twisting or cabling spindle apparatus according to claim 1, characterised in that the protective pot (3), below the touching line (23), has a conical region (21), which allows optimal receiving of conical (4A) or biconical (4B) supply bobbins in the protective pot (3).

9. Two-for-one twisting or cabling spindle apparatus according to claim 1, characterised in that the protective pot (3), in the region of the touching line (23), is equipped with a guide ring or a guide bead (17), along which the yarn (5) slides during the twisting or cabling process.

10. Two-for-one twisting or cabling spindle apparatus according to claim 9, characterised in that the guide ring or the guide bead (17) is fastened to the protective pot (3).

11. Two-for-one twisting or cabling spindle apparatus according to claim 9, characterised in that the guide ring or the guide bead (17) is fastened in the lower part of the lateral pot surface (18) of the protective pot (3).

12. Two-for-one twisting or cabling spindle apparatus according to claim 1, characterised in that a spacing (a), which is between 1 and 120 mm, is provided between the touching line (23) and the lower edge (20) of the storage disc (12).

* * * * *